US008213852B2

(12) United States Patent
Sasaki et al.

(10) Patent No.: US 8,213,852 B2
(45) Date of Patent: Jul. 3, 2012

(54) IMAGE FORMING APPARATUS AND CONTROL METHOD THEREFOR THAT CIRCULATE SHEETS FOR DUPLEX PRINTING

(75) Inventors: Ichiro Sasaki, Toride (JP); Naohisa Nagata, Moriya (JP); Akinobu Nishikata, Abiko (JP); Satoru Yamamoto, Abiko (JP); Hiroshi Matsumoto, Toride (JP)

(73) Assignee: Canon Kabushiki Kaisha (JP)

( * ) Notice: Subject to any disclaimer, the term of this patent is extended or adjusted under 35 U.S.C. 154(b) by 797 days.

(21) Appl. No.: 12/100,320

(22) Filed: Apr. 9, 2008

(65) Prior Publication Data

US 2008/0253818 A1 Oct. 16, 2008

(30) Foreign Application Priority Data

Apr. 10, 2007 (JP) ..... 2007-102924

(51) Int. Cl.
*G03G 15/00* (2006.01)

(52) U.S. Cl. ..... 399/402; 399/401

(58) Field of Classification Search ..... 399/401, 399/402, 397; 271/9.13, 3.16, 3.03, 291
See application file for complete search history.

(56) References Cited

U.S. PATENT DOCUMENTS 6,144,814 A * 11/2000 Newell et al. ..... 399/16
2001/0028819 A1* 10/2001 Okamoto ..... 399/401
2006/0056860 A1* 3/2006 Nojima ..... 399/16

FOREIGN PATENT DOCUMENTS

JP 2002-145535 A 5/2002
JP 2002365862 A 12/2002

OTHER PUBLICATIONS

JP Office Action issued Jan. 10, 2012 in corresponding JP2007-102924.

* cited by examiner

*Primary Examiner* — Judy Nguyen
*Assistant Examiner* — Justin Olamit
(74) *Attorney, Agent, or Firm* — Rossi, Kimms & McDowell LLP

(57) ABSTRACT

An image forming apparatus/method transports a sheet to an image forming unit that can form images on both sheet sides. The sheet is fed to the image forming unit at a predetermined image formation start timing for the first side image formation, thereafter is reversed, and re-fed to the image forming unit for the second side image formation while the first side image-formed sheet waits at least one of sheet waiting positions. A full state, where all the sheet waiting positions are full of the first side image-formed sheets, is detected. The number of sheets transported is controlled so that it is greater than the number of the sheet waiting positions. When the full state is detected, the sheet re-feeding is controlled so that a head sheet among the first side image-formed sheets waiting at the sheet waiting positions is fed in advance of the predetermined image formation start timing.

8 Claims, 9 Drawing Sheets

FIG. 6

| SHEET SIZE | THE NUMBER OF SHEET CIRCULATION PAGES | THE NUMBER OF CONTINUOUSLY FEEDABLE SHEETS FOR FIRST SIDE COPYING |
|---|---|---|
| L < 215.9mm | 13PAGE | 7SHEETS |
| L < 432.0mm | 7PAGE | 4SHEETS |
| L ≧ 432.0mm | 5PAGE | 3SHEETS |

IMAGE FORMING APPARATUS AND CONTROL METHOD THEREFOR THAT CIRCULATE SHEETS FOR DUPLEX PRINTING

BACKGROUND OF THE INVENTION

1. Field of the Invention

The present invention relates to an image forming apparatus, such as copying machines, and a control method therefor.

2. Description of the Related Art

Conventionally, when both sides of multiple documents are copied by an analog image forming apparatus that does not have a function of storing read original image information, the following approach is adopted. That is to say, image formation on the back side of a sheet is performed in such a way that a sheet with an image formed on one side by an image forming unit is not discharged outside the apparatus, but temporarily stacked on an intermediate tray, and upon reading an original image associated with the back side of the sheet, the sheet is re-fed to the image forming unit.

In contrast to this, an image forming apparatus having a function of storing the read original image can achieve a through-pass double-sided copying function, which does not have to stack the sheet with an image formed on one side, in double-sided copying (see, e.g., Japanese Laid-Open Patent Publication (Kokai) No. 2002-145535).

Next, the operation method of double-sided copying in the through-pass double-sided copying type image forming apparatus will be described with reference to FIG. 10.

FIG. 10 is a view schematically showing a configuration for illustrating the operation method of double-sided copying in the through-pass double-sided copying type image forming apparatus.

First, for example, an automatic document feeder feeds sheets, and all pages of a predetermined number of documents are read by a scanner, and stored in a storage unit (not shown). For example, when the document is a double-sided document, both sides are read, thereafter, images of a predetermined number of sheets, for example, three sheets of odd-numbered pages (the first page, the third page, and the fifth page) of a document are sequentially read from the storage unit. Then, after copying is sequentially performed on the front faces (first side) of the sheets, which are sequentially fed from a sheet feeding unit 601 in an image forming unit 602, three front face copied sheets P-1, P-2 and P-3 are reversed by a switchback unit 603. Subsequently, the sheets are sequentially transported in a double-sided path 604 to the image forming unit 602, and stopped in a first-to-last position relationship (in a non-stacked state).

When a first image of an even-numbered page is formed on the back face (second side) of the sheet, the first (head) sheet P-1 among the three sheets stopped within the double-sided path 604 is re-fed to the image forming unit 602 (hereinafter, this sheet re-feeding is referred to as the "double-sided sheet re-feeding"). Then, a toner image corresponding to the image of the second page read from the storage unit is formed on the back side of the first sheet P-1. At that time, the remaining two sheets P-2 and P-3 in the double-sided path 604 sequentially go ahead in preparation for the double-sided sheet re-feeding.

Next, the fourth sheet is newly fed from the sheet feeding unit 601 to have an original image of the seventh page formed on the front face, and is transported to the rearmost of the double-sided path 604 and stopped. Then, the second sheet P-2 stopped at the front end in the double-sided path 604 is fed to the image forming unit 602 in a double-sided sheet re-feeding fashion, and the original of the fourth page is copied on the back side thereof. Subsequently, a fifth sheet is newly fed to the image forming unit 602 from the sheet feeding unit 601, and the original of the ninth page is copied on the front face thereof.

In this manner, when the through-pass double-sided copying function is implemented, the double-sided path 604 is filled up with the single-sided copied sheets, and then feeding of a new sheet from the sheet feeding unit 601 and the double-sided sheet re-feeding are alternately performed.

Meanwhile, in recent years, since color printers have become widespread and their image quality has improved, the size of image data has been increased. One way of dealing with increased image size is compressing the image data saved in a hard disk drive (hereinafter referred to as the "HDD"). Before image formation is performed, the image data is read from the HDD and decompressed. Further, printers have emerged which need much time for image data processing because functionality of the printers is expanded and an original image is subjected to various types of image processing; thus further time is needed for preparation of image data before image formation is performed.

Above all, some image forming apparatuses using an intermediate transfer body, for example, generate the timing of sheet feeding from a sheet feeding unit based on the timing of the start of image formation because the time required to form a toner image is longer than the time required to feed and transport sheets. In such apparatuses, since image formation must be started before the timing of the start of double-sided sheet re-feeding, the preparation time of image data must be within a predetermined time period.

Under such circumstances, if a delay in the preparation time of data of an image to be formed is caused due to delay in reading the data from the HDD or the like, the double-sided sheet re-feeding of the sheet P-1 stopped at the front end in the double-sided path 604 is delayed. As a result, the number of sheets that are circulating through the apparatus (the number of sheet circulation pages) sometimes exceeds the number of positions where single-sided copied sheets are stopped within the double-sided path 604 (the number of sheet stop positions). In such a case, there is a problem that a malfunction such as jamming occurs due to a collision of a later sheet with an earlier sheet.

For example, a case is assumed where, in a configuration in which there are three sheet stop positions as shown in FIG. 10, the number of the sheet circulation pages is seven. That is to say, a case is assumed where the sheet feeding unit is controlled to initially continuously feed four sheets (the first page, the third page, the fifth page, and the seventh page) for first side copying (see FIG. 7B described later). After a minimum time (see ST in FIG. 5 described later) required for a sheet to circulate through the apparatus for first side copying and to be re-fed for second side copying has elapsed, the sheet of the seventh page is fed from the sheet feeding unit. Then, the head sheet (corresponding to P-1 in FIG. 10) stopped at a stop position in the double-sided path 604 is re-fed as a second page.

At that time, if the double-sided sheet feeding of the sheet of the head second page is delayed, a full state is reached in which the sheets are waiting at all the three stop positions within the double-sided path 604. As a result, since there is no stop position for the first side-copied sheet of the seventh page, the sheet of the seventh page collides with a sheet waiting at the rearmost stop position (corresponding to P-3 in FIG. 10).

Conventionally, in order to avoid such a malfunction, the number of the sheet circulation pages X has been determined so as not to exceed the number of the sheet stop positions Y (X=2Y−1). That is to say, in the configuration example in FIG. 10 in which there are three sheet stop positions, the number of the sheet circulation pages has been controlled to be five, that is, the sheet feeding unit has been controlled to initially continuously feed three sheets (the first page, the third page, and the fifth page) for first side image formation (see FIG. 7B described later).

However, in such control, the number of the sheet circulation pages cannot be increased, thus productivity is adversely affected. Accordingly, in order to satisfy productivity, a method of enhancing the speed of sheet transport and a method of increasing sheet stop positions have been known, and, for example, there is a method of controlling the speed of sheet transport by sheet size (e.g., Japanese Laid-Open Patent Publication (Kokai) No. 2005-280897).

As described above, the method of enhancing the speed of sheet transport in order to satisfy productivity needs an expensive drive motor or the like, resulting in increase in cost. Further, for the method of increasing sheet stop positions, there is a problem that the apparatus is upsized.

SUMMARY OF THE INVENTION

The present invention provides an image forming apparatus and a control method therefor that can satisfy productivity at the time of double-sided image formation without jamming due to a collision of a succeeding sheet with a preceding sheet, and without upsizing of the apparatus.

In a first aspect of the invention, there is provided with an image forming apparatus having an image forming unit arranged to form an image on a sheet, and performing a sheet circulation transport for circulating and transporting the sheet to the image forming unit to perform image formation on both a first side and a second side of the sheet, comprising: a sheet feeding unit arranged to feed the sheet to the image forming unit at a predetermined image formation start timing (synonymous with time) for the first side image formation; a sheet re-feeding unit arranged to reverse the first side image-formed sheet, and re-feed the first side image-formed sheet to the image forming unit for the second side image formation while causing the first side image-formed sheet to wait in at least one of sheet waiting positions; a full state detecting unit arranged to detect a full state where all the sheet waiting positions are full of the first side image-formed sheets; and a control device arranged to control the sheet feeding unit so that the number of sheets on which the sheet circulation transport is performed is greater than the number of the sheet waiting positions, and, when the full state detecting unit detects the full state, control the sheet re-feeding unit so that a head sheet among the first side image-formed sheets waiting at the sheet waiting positions is fed in advance of the predetermined image formation start timing.

The control device can transport the head sheet fed in advance of the predetermined image formation start timing to a registration alignment position, and then temporarily stops the head sheet.

In a second aspect of the invention, there is provided with a control method of an image forming apparatus having an image forming unit arranged to form an image on a sheet, performing a sheet circulation transport for circulating and transporting the sheet to the image forming unit to perform image formation on both a first side and a second side of the sheet, the image forming apparatus comprising a sheet feeding unit arranged to feed the sheet to the image forming unit at a predetermined image forming start timing for the first face image formation; and a sheet re-feeding unit arranged to reverse the first side image-formed sheet, and re-feed the first side image-formed sheet to the image forming unit for the second side image formation while causing the first side image-formed sheet to wait in at least one of sheet waiting positions, the control method comprising the steps of: detecting a full state where all the sheet waiting positions are full of the first side image-formed sheets; and controlling the sheet feeding unit so that the number of sheets on which the sheet circulation transport is performed is greater than the number of the sheet waiting positions, and, when the full state detecting unit detects the full state, controlling the sheet re-feeding unit so that a head sheet among the first side image-formed sheets waiting at the sheet waiting positions is fed in advance of the predetermined image formation start timing.

The control step can comprise transporting the head sheet fed in advance of the predetermined image formation start timing to a registration alignment position, and then temporarily stopping the head sheet.

According to the present invention, sheet circulation transport can be performed while keeping the number of sheets maximum. Further, even if a delay in the preparation of an image to be formed is caused due to delay in reading from the HDD or the like, control can be provided to prevent the sheet circulation transport from being disturbed, and to prevent jamming or the like from occurring due to a collision of a succeeding sheet with a preceding sheet. This eliminates the need to upsize the apparatus due to an increase in sheet waiting points, thus allowing the productivity at the time of double-sided image formation to be maintained. Furthermore, this eliminates the need to use an expensive drive motor or the like due to enhancement of the speed of sheet transport, thus cost can be reduced.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 6 is a table showing the number of he sheet circulation pages in the image forming apparatus of FIG. 1.

DETAILED DESCRIPTION OF THE PREFERRED EMBODIMENTS

Preferred embodiments of the present invention will be now described in detail with reference to the drawings.

<Configuration of Image Forming Apparatus>

Figure 1:
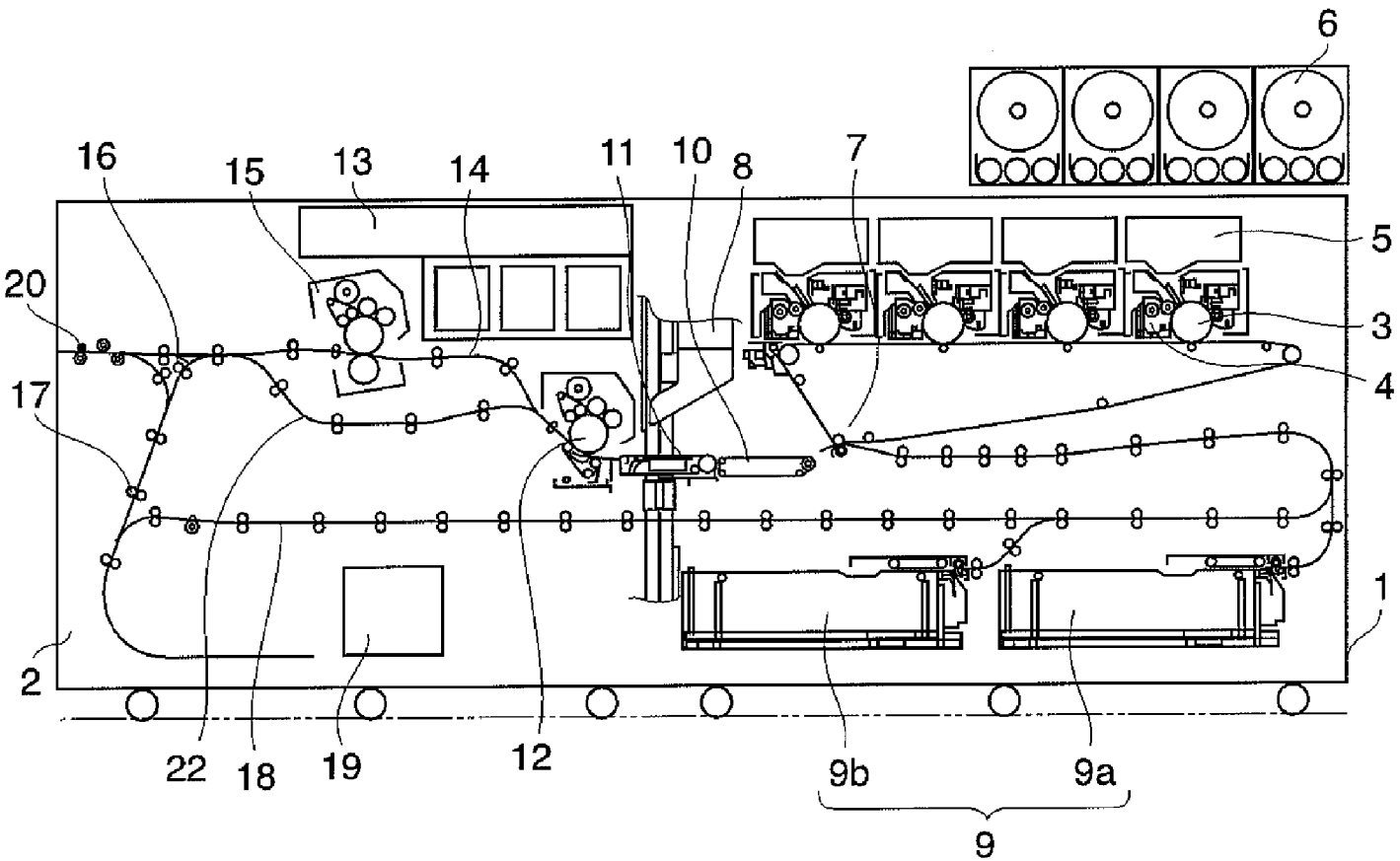
FIG. 1 a cross-sectional view showing a configuration of an image forming apparatus according to an embodiment of the present invention.

FIG. 1 a cross-sectional view showing a configuration of an image forming apparatus according to an embodiment of the present invention.

As shown in FIG. 1, the image information device has a first chassis unit 1 and a second chassis unit 2, which constitute a main body of the image forming apparatus. A photosensitive drum 3, a developing device 4, an exposure unit 5, a hopper unit 6, a transfer unit 7, an exhaust unit 8, a sheet feeding deck unit 9, and a first belt transport unit 10 are disposed in the first chassis unit 1.

The developing device 4 causes toner to adhere to a latent image formed on the photosensitive drum 3 to render the image visible. The exposure unit 5 exposes image information on the photosensitive drum 3 to form a latent image, and the hopper unit 6 replenishes the developing device with toner. The transfer unit 7 transfers to a sheet (recording medium) the toner image rendered visible on the photosensitive drum 3. The exhaust unit 8 uses a fan (not shown) to exhaust air from the first chassis. The sheet feeding deck unit 9 has a right deck 9*a* and a left deck 9*b*, each of which feeds sheets, and the first belt transport unit 10 transports the transferred sheet to the second chassis unit.

The second chassis unit 2 is provided with a second belt transport unit 11, a first fixing unit 12, and an exhaust duct 13, and further, with a transport path 14, a second fixing unit 15, a sheet re-feeding transport path 16 (sheet re-feeding device), a reversing path 17, a double-sided path 18, a waste toner bottle 19, a sheet discharge path 20, and a bypass transport path 22.

The second belt transport unit 11 transports to the second chassis unit 2 a sheet having thereon an not-yet-fixed image for which toner image has been transferred on the side of the first chassis unit 1. The first fixing unit 12 fixes onto the sheet, the image on the sheet for which toner image has been transferred in the first chassis unit 1. The exhaust duct 13 mainly exhausts heat from the fixing unit in the second chassis unit 2. Further, the transport path 14 is for linking the first fixing unit 12 and the second fixing unit 15. The second fixing unit 15 is for performing gross control to achieve the improvement of image quality.

The re-feeding transport path 16 is for guiding sheets to be re-fed at the time of double-sided copying. The reversing path 17 is for reversing the sheets to be re-fed. The double-sided path 18 is for transporting the reversed sheets to the transfer unit 7. The waste toner bottle 19 is for storing waste toner. The sheet discharge path 20 is for discharging sheets in which image formation is finished, outside the apparatus. The bypass transport path 22 is for feeding the sheets, which have passed through the first fixing unit 12, directly to the re-feeding transport path 16 or the sheet discharge path 20.

<Configuration of Control Unit>

Figure 2:
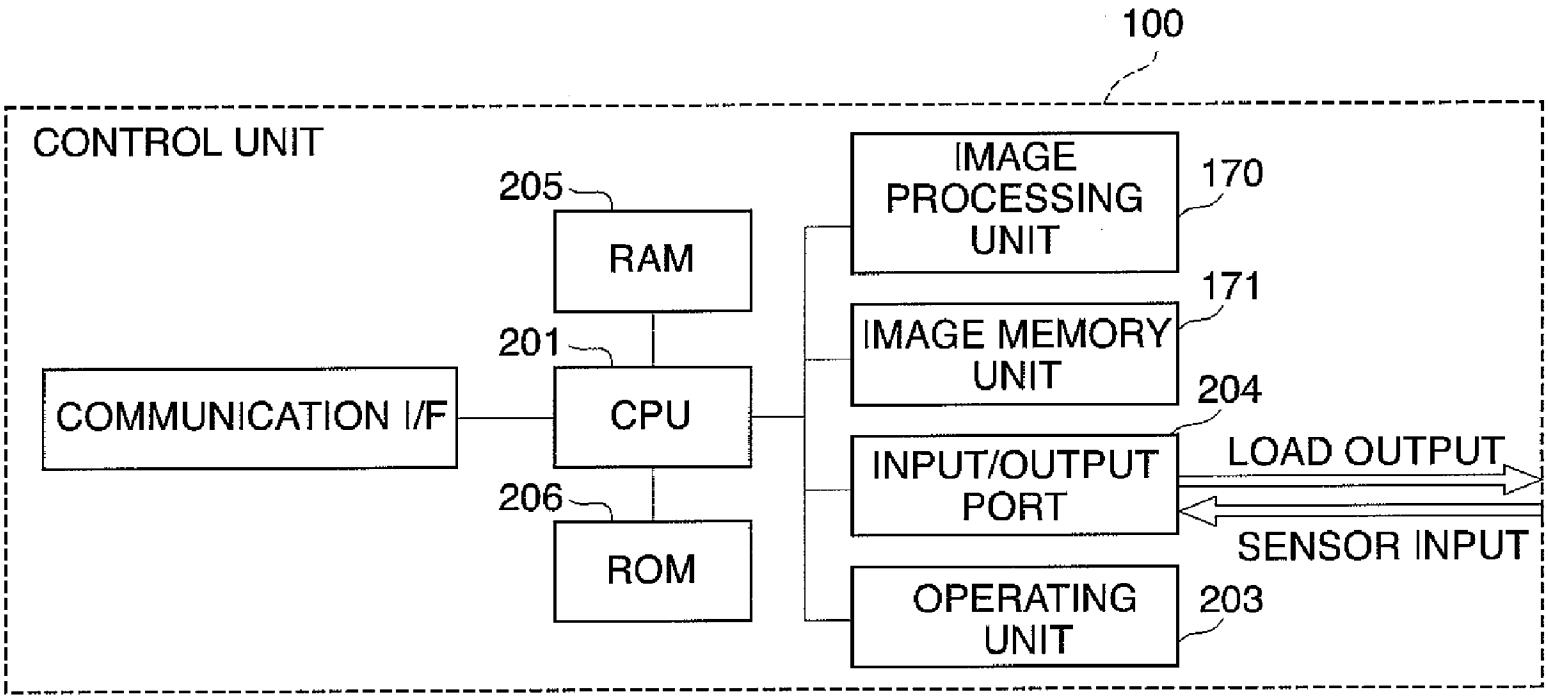
FIG. 2 is a block diagram showing a configuration of a control unit in the image forming apparatus of FIG. 1.

FIG. 2 is a block diagram showing a configuration of a control unit in the image forming apparatus of FIG. 1.

The control unit 100 is provided with a CPU 201 that performs basic control of the image forming apparatus of FIG. 1. A ROM 206 into which a control program is written, a work RAM 205 for performing processing, and an input/output port 204 are connected to the CPU 201 through address bases and data bases.

Some areas of the ROM 205 serve as a backup RAM where data is not deleted even if a power source is turned off. A motor controlled by the image forming apparatus, various loading devices such as a clutch, and an input device to the image forming apparatus such as a sensor, which senses the position of sheet, are connected to the input/output port 204.

The CPU 201 sequentially controls input/output via the input/output port 204 according to the contents of the control program in the ROM 206, and performs image formation. An operating unit 203 is also connected to the CPU 201, and the CPU 201 controls a display device and a key input device, which are not shown, of the operating unit 203. A user uses the key input device to instruct the CPU 201 to switch between image formation operation modes and between views, and the CPU 201 shows the operating state of the image forming apparatus, and the operation mode that is set by the key input, on the display device of the operating unit 203. An image processing unit 170 for processing image signals and an image memory unit 171 for accumulating processed images are also connected to the CPU 201.

<Inner Configuration and Peripheral Devices of Image Memory Unit 171>

Figure 3:
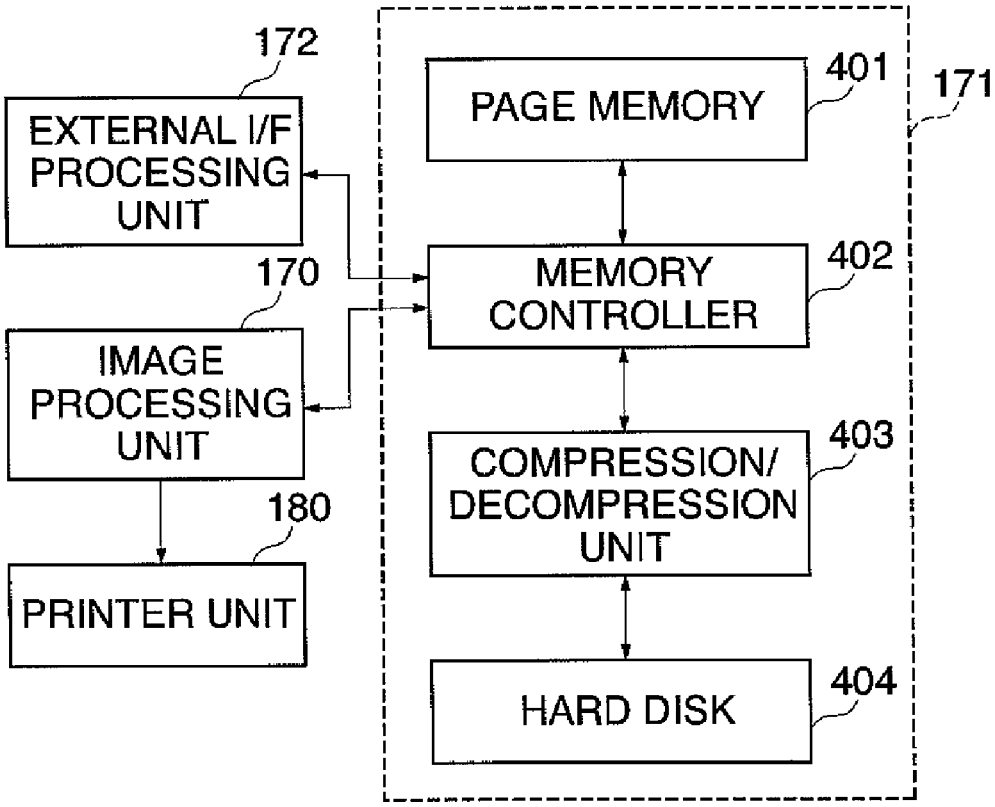
FIG. 3 is a block diagram showing the inner configuration and the periphery of an image memory unit in FIG. 2.

FIG. 3 is a block diagram showing the inner configuration and the peripheral devices of the image memory unit 171 in FIG. 2.

The image memory unit 171 is comprised of a page memory 401, a memory controller unit 402, a compression/decompression unit 403 and a hard disk 404. Image data sent from an external I/F processing unit 172 and the image processing unit 170 to the image memory unit 171 is written into the page memory 401 by the memory controller unit 402. Subsequently, the data is sent to a printer unit 180 through the image processing unit 170, or accumulated in the hard disk 404. When the image data is accumulated in the hard disk 404, the image data is compressed by the compression/decompression unit 403, and written into the hard disk 404 as compressed data.

The memory controller 402 also reads out to the page memory 401 the image data stored in the hard disk 404. At that time, the compressed data read from the hard disk 404 is decompressed by the compression/decompression unit 403, and the uncompressed image data is written into the page memory 401. In addition, the memory controller unit 402 generates DRAM refresh signals that are to be sent to the page memory 401. The memory controller unit 402 also conducts arbitration of the access from the external I/F processing unit 172, the image processing unit 170 and the hard disk 404 to the page memory 401. Further, according to instructions from the CPU 201, the memory controller unit 402 determines and controls a write address into the page memory 401, a read address from the page memory 401, a readout direction and the like.

The above processing allows the CPU 201 to arrange and lay out a plurality of original images in the page memory 401, and then control a function of outputting the images to the printer unit 2 through the image processing unit 170. Further, the CPU 201 can control a function of cutting only a portion of an image and outputting it, and a function of rotating an image.

<Sheet Transport Control at the Time of Double-Sided Copying>

The sheet transport control processing at the time of double-sided copying, which is performed by the image forming apparatus of FIG. 1, will now be described.

(A) Sheet Transport Control

Figure 4:
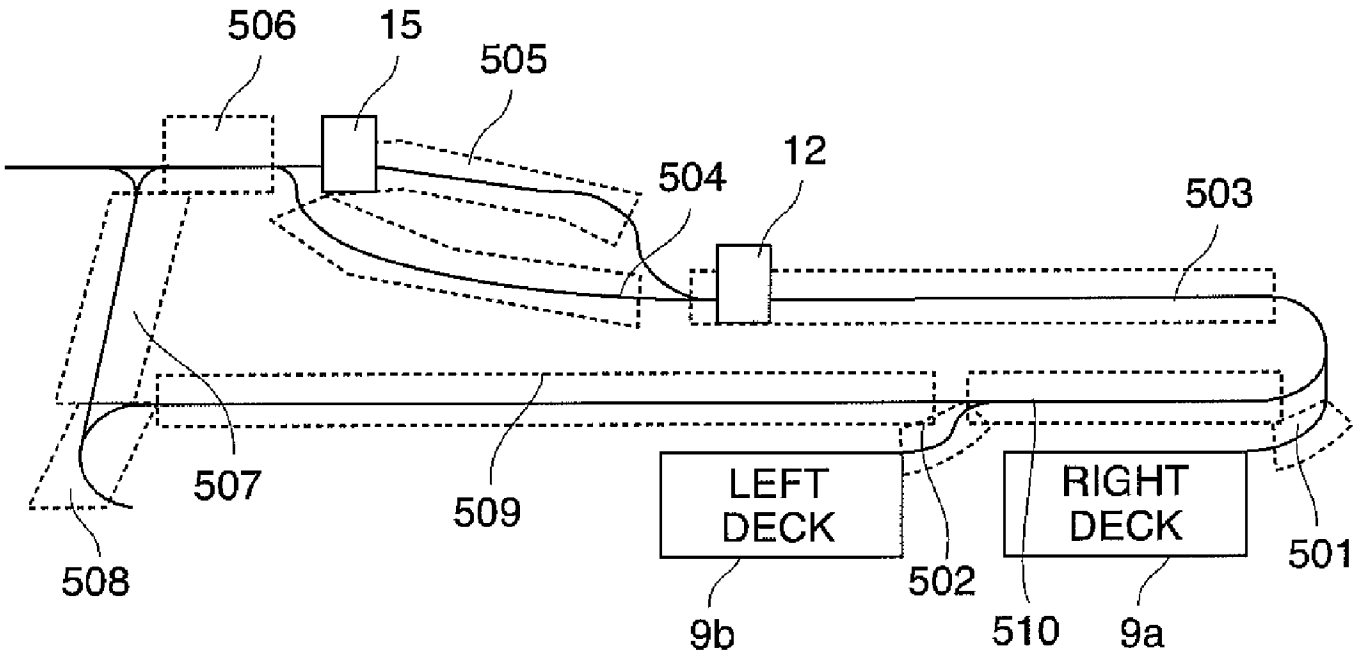
FIG. 4 is a view useful in explaining a sheet transport path of the image forming apparatus of FIG. 1.

FIG. 4 is a view useful in schematically explaining a sheet transport path of the image forming apparatus of FIG. 1.

A sheet transport path system in the present embodiment is comprised of roughly classified ten sheet transport paths.

That is to say, a right deck sheet feeding path 501, a left deck sheet feeding path 502, a main transport path 503, a bypass transport path 504 (reference numeral 22 in FIG. 1), a first fixing path 505 (reference numeral 14 in FIG. 1), and a straight sheet discharge path 506 are disposed in the sheet transport path system. Further, the sheet transport path system is provided with a reverse discharge path 507 (reference numeral 17 in FIG. 1), a double-sided reversing path 508, a double-sided transport path 509 (reference numeral 18 in FIG. 1) and a double-sided sheet re-feeding path 510, as a path used in double-sided copying.

The procedure of the sheet transport control processing at the time of double-sided copying, which is performed by the image forming apparatus of FIG. 1, will now be described.

First, based on the start of the formation of a latent image for the first side of a sheet with respect to the photosensitive drum 3, the sheet is fed from the right deck 9*a* after a predetermined time has elapsed. Here, the predetermined time is a difference between a time required for the latent image to travel from an exposure position on the photosensitive drum 3 to the transfer unit 7 and a time required for the sheet transported by the sheet feeding deck unit 9 to travel to the transfer unit 7 through the main transport path 503. The right deck 9*a* and the left deck 9*b* must be made different in the predetermined time from each other, because they have different sheet transport path distances.

Next, after passing through the first fixing unit 12, the sheet for which the toner image has been transferred is transported to the straight sheet discharge path 506 through either of the bypass transport path 504 or the first fixing path 505, depending on the type of the sheet. The straight sheet discharge path 506 has a path switching mechanism (not shown), by which first side-copied sheets are transported to the reverse discharge path 507, and second side-copied sheets are transported in such a direction that the sheets are directly discharged outside the apparatus.

The first side-copied sheet transported to the reverse discharge path 507 is reversed by the double-sided reversing path 508, and fed to the double-sided transport path 509. The double-sided transport path 509 has a plurality of positions where sheets can be stopped according to size (sheet stop position) so as to control sheets to be transported to a stop position where there is no preceding sheet. When a preceding sheet exists on a stop position, the transport of the succeeding sheet is temporarily stopped at the previous stop position. Subsequently, at the timing at which the preceding sheet exits from the stop position, or at the timing at which the preceding sheet is determined to exit from the stop position, the transport of the succeeding sheet temporarily stopped is restarted.

Based on the start of the formation of a latent image for second side copying with respect to the photosensitive drum 3, the double-sided sheet re-feeding operation is started after the predetermined time has elapsed, and the sheet that reached the end of the double-sided transport path 509 is transported to the double-sided sheet re-feeding path 510. Thereafter, as described above, after passing through a process in which a toner image is transferred to the sheet, and a process in which the toner image is fixed onto the sheet, the sheet is discharged outside the apparatus.

The double-sided copying of the first side and the second side is performed by continuously carrying out this series of sheet transport alternating between the first side copying and the second side copying.

Figure 5:
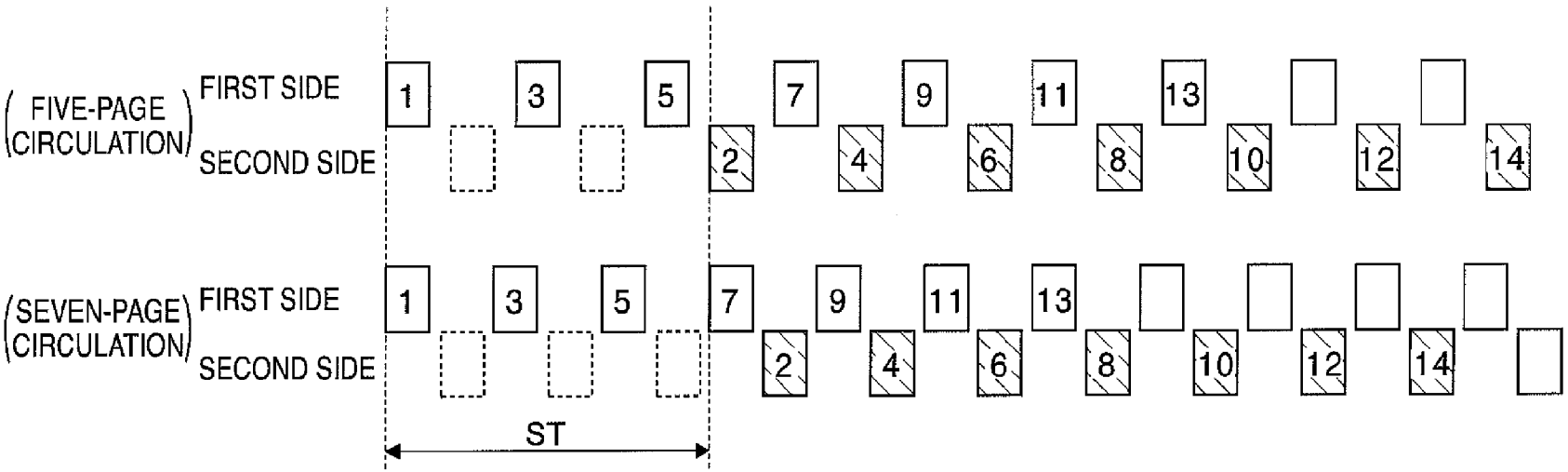
FIG. 5 is a view showing the sequence of sheet transport control processing at the time of double-sided copying performed by the image forming apparatus of FIG. 1.

FIG. 5 shows the sequence of sheet transport control processing at the time of double-sided copying performed by the image forming apparatus of FIG. 1.

FIG. 5 shows a five-page circulating sequence with the number of sheet circulation pages of five, and a seven-page circulating sequence with a sheet circulation page number of seven. In the five-page circulating sequence, after three sheets for first side copying (the first page, the third page, and the fifth page) are initially continuously fed from the sheet fixing deck unit 9, the first side copying and the second side copying are continuously alternated. In the seven-page circulating sequence, after four sheets for first side copying (the first page, the third page, fifth page, and the seventh page) are initially continuously fed from the sheet feeding deck unit 9, the first side copying and the second side copying are continuously alternated. Note that ST shown in FIG. 5 indicates a minimum time required for a first side-copied sheet to circulate and to be fed for second side copying.

(B) The Number of Sheet Circulation Pages

FIG. 6 is a table showing the number of sheet circulation pages in the image forming apparatus of FIG. 1.

In the example of FIG. 6, three types of sheet circulation control are performed depending on sheet sizes. The sheet circulation page number X is set in such a way that the multiplication factor of the minimum time (ST in FIG. 5) required for a first side-copied sheet to circulate and be fed for second side copying, with respect to the time corresponding to productivity determined by sheet size, is less than a minimum even number N. That is to say, the relationship between N and X is as follows:

$$X=N-1$$

(C) The Number of Relationship Between Sheet Circulation Pages and the Number of Sheet Stop Positions Next, the relationship between the sheet circulation page number described above and the sheet stop position number will be described with reference to FIGS. 7A to 7C.

Figure 7A:
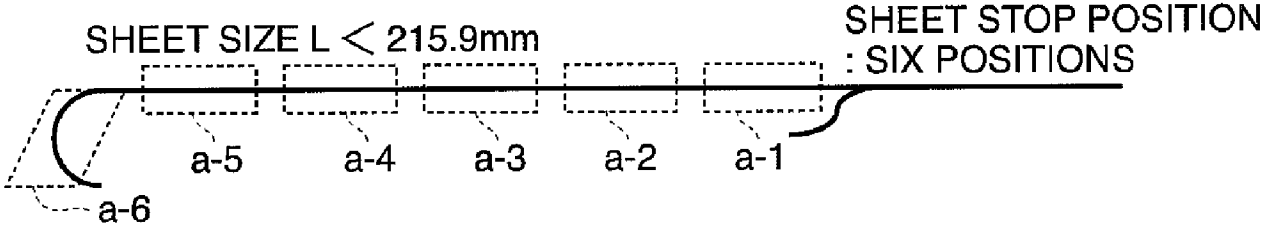
FIGS. 7A to 7C are views useful in explaining sheet stop positions in the image forming apparatus of FIG. 1.
Figure 7B:
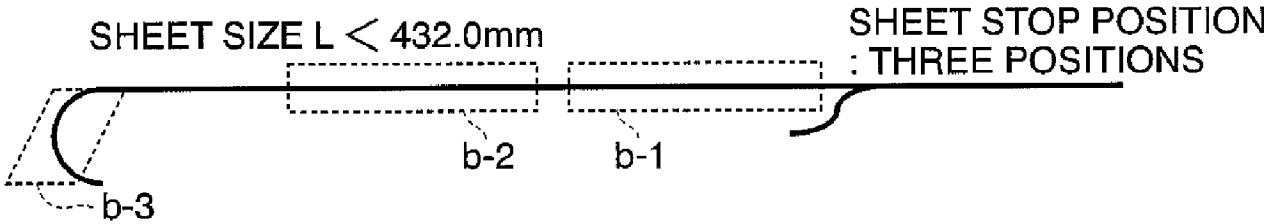
Figure 7C:
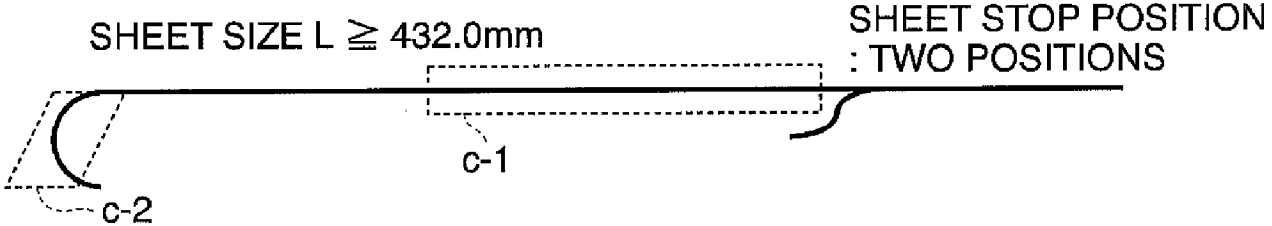

FIGS. 7A to 7C are views useful in explaining sheet stop positions in the image forming apparatus of FIG. 1.

As shown in FIG. 7, the relationship between the sheet circulation page number and the sheet stop position number is as follows:

the number of sheet circulation pages: 13←→the number of sheet stop positions: 6 (a-1 to a-6 in FIG. 7A)

the number of sheet circulation pages: 7←→the number of sheet stop positions: 3 (b-1 to b-3 in FIG. 7B)

the number of sheet circulation pages: 5←→the number of sheet stop positions: 2 (c-1 and c-2 in FIG. 7C)

That is to say, the number of the sheet stop positions (that is, the number of waiting sheets) Y and the number of the sheet circulation pages X can be expressed as follows:

$$X=2Y+1$$

Figure 10:
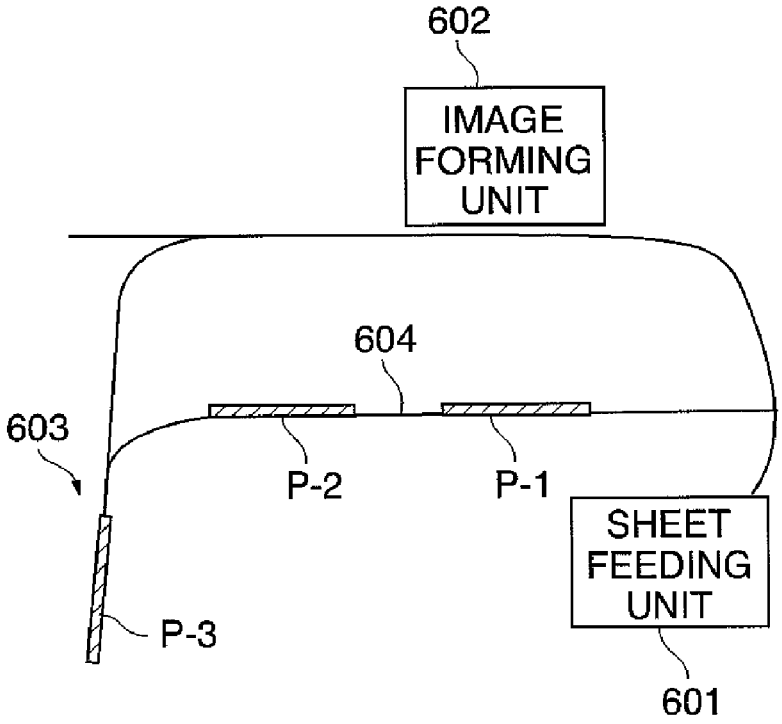
FIG. 10 is a view schematically showing a configuration for illustrating the operation of double-sided copying in a through-pass double-sided copying type image forming apparatus.

The number of waiting sheets Y is one sheet less than the number of continuously feedable sheets for the first side-copied sheets in FIG. 10. That is to say, in the present embodiment, the number of sheet stop positions at the time of double-sided copying can be reduced.

Also in the sheet transport control processing in such (X=2Y+1), as described with reference to FIG. 5, sheets are initially continuously fed for first side copying, and images are formed, and, immediately after the ST time has elapsed, the head sheet among the sheets that are waiting at sheet stop positions is re-fed for second side copying. Thus, since some of sheet stop positions become available, the next first side-copied sheet is fed thereto.

At that time, if a delay in the preparation of data of an image to be formed is caused due to delay in reading from the HDD or the like, the double-sided sheet re-feeding of the head sheet for second side copying would be delayed. Accordingly, this causes a shortage of sheet stop positions, thus leading to a problem that a malfunction such as jamming occurs due to a collision of a succeeding sheet with a preceding sheet in the double-sided reversing path 508.

According to the present embodiment, in order to avoid the malfunction, the following control is performed. That is to say, when it is detected (detection of full state) that all the sheet stop positions are full of sheets (full state), the double-sided sheet re-feeding of the head sheet waiting at the sheet stop position is controlled to be performed in advance of the start of image formation, which is originally the timing of feeding. Hereinafter, such characteristic sheet transport control processing of the present embodiment will be described in detail with reference to FIGS. 8 and 9.

(D) Sheet Transport Control Processing

Figure 8:
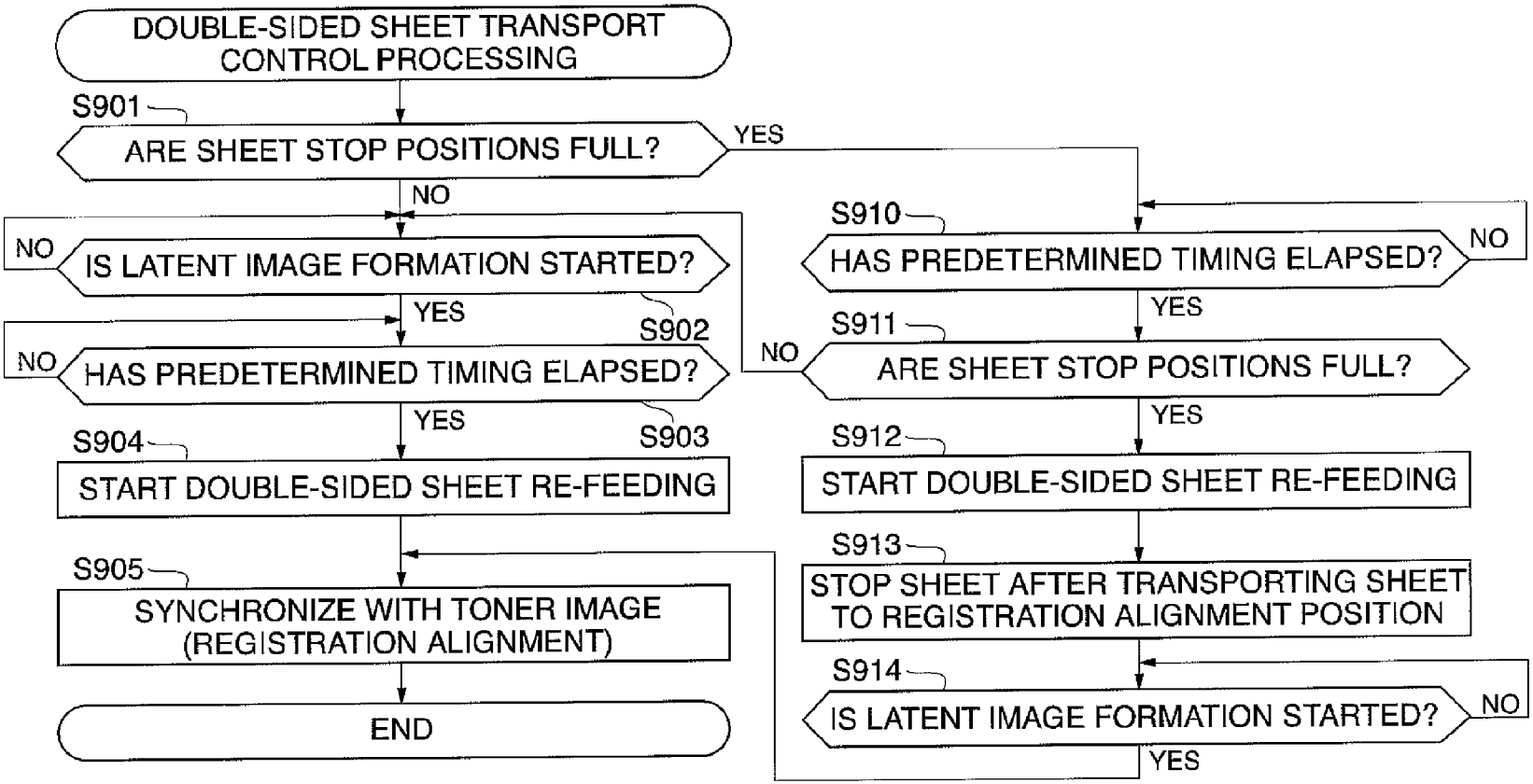
FIG. 8 is a flowchart showing the sheet transport control processing performed by the image forming apparatus of FIG. 1.
Figure 9:
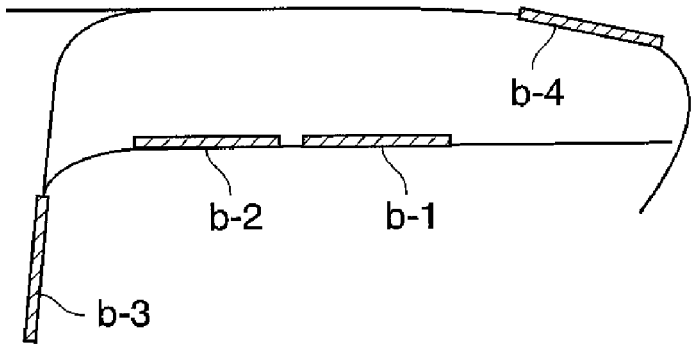
FIG. 9 is a view useful in explaining the sheet transport control processing performed by the image forming apparatus of FIG. 1.

FIG. 8 is a flowchart showing the sheet transport control processing performed by the image forming apparatus of FIG. 1. FIG. 9 is a view useful in explaining the sheet transport control processing performed by the image forming apparatus of FIG. 1.

For ease of explanation, in the examples in FIGS. 8 and 9, the seven-page circulating sequence with the number of sheet circulation pages of seven (see FIG. 5) is performed in a configuration in which there are three sheet stop positions as shown in FIG. 9, for example. Further, the control is achieved in such a way that a program code for sheet transport control stored in the ROM 206 is read, and the CPU 201 performs the program code.

Initially, it is determined whether or not the sheet stop positions b-1 to b-3 are full (step S901). If the sheet stop positions are not full at this point of time, the apparatus waits until a predetermined timing for starting latent image formation (step S902), on the other hand, if the sheet stop positions are full, waits until a predetermined timing at which there is no collision of sheets (step S910), and then the apparatus determines again whether or not the sheet stop positions b-1 to b-3 are full (step S911).

As a result of the determination of step S901, if the sheet stop positions b-1 to b-3 are not full (NO to the step S901), when latent image formation is started (YES to the step S902), the apparatus starts double-sided sheet re-feeding after waiting until double-sided sheet re-feeding timing (YES to the step S903), and transports a sheet for second side copying (step S904).

Finally, synchronization is performed (hereinafter referred to as the "registration alignment") so that the front end of the sheet for second side copying for which transport has been started, and the front end for a toner image which is formed from a latent image are fed to the transfer unit 7 at the same timing (step S905), followed by terminating the process.

As a result of the determination of step S911, if the sheet stop positions are not full, processes from steps S902 to S905 are performed as described above, followed by terminating the process.

As a result of the determination of step S911, if the sheet stop positions are full, the apparatus determines that the sheets might collide at the sheet stop position b-3, and starts the double-sided sheet re-feeding of the head sheet (the second page in FIG. 5) waiting at the sheet stop position b-1 (step S912), without waiting until the original double-sided sheet re-feeding timing (after a predetermined time has elapsed from the start of latent image formation). Thus, a waiting space for the subsequent first side-copied sheet (the seventh page in FIG. 5) can be reserved.

Next, the sheet for which the double-sided sheet re-feeding has been started earlier is transported to the predetermined position b-4 on the main transport path 503 where the registration alignment described above is performed, and the sheet is temporarily stopped (step S913), and the start of latent image formation is waited for (step S914). In this manner, the sheet for which the double-sided sheet re-feeding has been started earlier is temporarily stopped to carry out adjustment of the timing with the latent image formation start timing (predetermined timing).

Finally, when the latent image formation is started (YES to the step S914), the registration alignment is performed (step S905), followed by terminating the process.

Note that in the present embodiment, the transport of the sheets temporarily stopped at the later sheet stop positions b-2 and b-3 is restarted immediately after the double-sided sheet re-feeding is started in the step S912, which is not shown in FIG. 8. Accordingly, this allows the double-sided reversing path 508, which is the last sheet stop position b-3, to be available so as to accept the last sheet for first side copying.

Further, in the present embodiment, the determination of whether or not the sheet stop position is full is based on a condition that a difference between the number of the fed first side-copied sheets and the number of the sheets for second side copying becomes zero. The similar determination can be performed by other methods.

<Advantage of the Present Embodiment>

Conventionally, because of a problem in specific environment such as delay in reading from the HDD or the like, the number of the sheet circulation pages is reduced ($X=2Y-1$), thus productivity is adversely affected; in contrast to this, in the present embodiment, if the sheet stop positions b-1 to b-3 are full (YES to the step S911), the apparatus does not wait until the double-sided sheet re-feeding timing (skips the step S903), but starts the double-sided sheet re-feeding (step S912), thus sheet transport control can be performed while keeping the number of double-sided sheet circulation pages maximum ($X=2Y+1$). Further, even if a delay in the preparation of an image to be formed is caused due to delay in reading from the HDD or the like, control can be provided to prevent the sheet transport control from being disturbed, and to prevent jamming or the like from occurring due to a collision of a succeeding sheet with a preceding sheet. This eliminates the need to upsize the apparatus due to an increase in sheet stop positions, thus the productivity at the time of double-sided copying can be satisfied. Furthermore, this eliminates the need to use an expensive drive motor or the like due to enhancement of the speed of sheet transport, thus cost can be reduced.

It is to be understood that the object of the present invention may be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, an HDD, a magnetic-optical disk, a CD-ROM, a CD-R, a CD-RW, a DVD-ROM, a DVD-RAM, a DVD-RW, a DVD+RW, a magnetic tape, a non-volatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the accrual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-102924 filed Apr. 10, 2007, which is hereby incorporated by reference herein in its entirety.

What is claimed is:

1. An image forming apparatus having an image forming unit configured to form an image on a photosensitive member and transfer the image formed on the photosensitive member onto a sheet so that an image is formable on each of a first side and a second side of the sheet, the image forming apparatus comprising:

a sheet feeding unit configured to feed the sheet to said image forming unit;

a sheet re-feeding unit configured to reverse the sheet with the first side formed with an image, and re-feed, via a transport path for sheet re-feeding, the reversed sheet to said image forming unit to form an image on the second side of the sheet, the sheet re-feeding unit causing:

a plurality of sheets transported in the transport path to temporarily stop at a plurality of stop positions, the sheet stopped at a most downstream stop position of the transport path to said image forming unit to be fed at predetermined re-feeding timing, and the sheets stopped at the remaining stop positions to be transported to the next stop positions;

a full state detecting unit configured to detect a full state where all the plurality of stop positions are occupied by sheets; and a control device configured to:

control said sheet feeding unit and said sheet re-feeding unit to continuously perform image formation on the first side of a predetermined number of sheets fed by said sheet feeding unit, and then alternately perform image formation on the second side of the sheet re-fed by said sheet re-feeding unit and the first side of a new sheet fed by said sheet feeding unit;

control said sheet re-feeding unit to, when said full state detecting unit detects the full state, at a predetermined timing before the sheet with the first side formed with the image reaches the most upstream stop position among the plurality of stop positions, re-feed the sheet stopped at the most downstream stop position in advance of the predetermined re-feeding timing, and transport the sheets stopped at the remaining stop positions to the next stop positions, respectively; and control said sheet re-feeding unit to, when said full state detecting unit does not detect the full state at the predetermined timing before the sheet with the first side formed with the image reaches the most upstream stop position among the plurality of stop positions, re-feed the sheet stopped at the most downstream stop position at the predetermined re-feeding timing, and transport the sheets stopped at the remaining stop positions to the next stop positions, respectively.

2. The image forming apparatus according to claim 1, further comprising:

a transport unit configured to transport the sheet fed by said sheet feeding unit and the sheet re-fed by said sheet re-feeding unit to said image forming unit, wherein said control device controls said transport unit to cause the sheet re-fed from the most downstream stop position in advance of the predetermined re-feeding timing to temporarily stop at a predetermined position of said transport unit.

3. The image forming apparatus according to claim 2, wherein:

said transport unit comprises a registration alignment unit configured to perform transporting according to a transfer timing of said image forming unit, and said control device is configured to control said transport unit to cause the sheet re-fed from the most downstream stop position in advance of the predetermined re-feeding timing to temporarily stop at said registration alignment unit.

4. The image forming apparatus according to claim 1, wherein the predetermined number is greater by one than the number of the stop positions.

5. A method of controlling an image forming apparatus having an image forming unit configured to form an image on a photosensitive member and transfer the image formed on the photosensitive member onto a sheet so that an image is formable on each of a first side and a second side of the sheet, said image forming apparatus comprising a sheet feeding unit configured to feed the sheet to said image forming unit; and a sheet re-feeding unit configured to reverse the first side image-formed sheet, and re-feed, via a transport path for sheet re-feeding, the reversed sheet to said image forming unit to form an image on the second side of the sheet, the sheet re-feeding unit causing a plurality of sheets transported on the transport path to temporarily stop at a plurality of stop positions, the sheet stopped at a most downstream stop position of the transport path to be fed to said image forming unit at a predetermined re-feeding timing, and the sheets stopped at the remaining stop positions to be transported to the next stop positions, the method comprising the steps of:

detecting a full state where all plurality of stop positions are full of a plurality of sheets; and controlling said sheet feeding unit and said sheet re-feeding unit to continuously perform image formation on the first side of a predetermined number of sheets fed by said sheet feeding unit, and then alternately perform image formation on the second side of the sheet re-fed by said sheet re-feeding unit and the first side of a new sheet fed by said sheet feeding unit;

controlling said sheet re-feeding unit to:

when said full state detecting step detects the full state, at a predetermined timing before the sheet with the first side formed with the image reaches a most upstream stop position among the plurality of stop positions, re-feed the sheet stopped at the most downstream stop position in advance of the predetermined re-feeding timing, and transport the sheets stopped at the remaining stop positions to the next stop positions, respectively; and when said full state detecting step does not detect the full state at the predetermined timing before the sheet with the first side formed with the image reaches the most upstream stop position among the plurality of stop positions, re-feed the sheet stopped at the most downstream stop position at the predetermined re-feeding timing, and transport the sheets stopped at the remaining stop positions to the next stop positions, respectively.

6. The method according to claim 5, wherein:

said image forming apparatus further comprises a transport unit configured to transport the sheet fed by said sheet feeding unit and the sheet re-fed by said sheet re-feeding unit to said image forming unit, and said control step controls said transport unit to cause the sheet re-fed from the most downstream stop position in advance of the predetermined pre-feeding timing to temporarily stop at a predetermined position of said transport unit.

7. The method according to claim 5, wherein the predetermined number is greater by one than the number of the stop positions.

8. The method according to claim 6, wherein:

said transport unit comprises a registration alignment unit configured to perform transporting according to a transfer timing of said image forming unit, and said control step controls said transport unit to cause the sheet re-fed from the most downstream stop position in advance of the predetermined pre-feeding timing to temporarily stop at said registration alignment unit.

* * * * *